United States Patent [19]

Kozak et al.

[11] 4,017,338

[45] Apr. 12, 1977

[54] STEEL MEMBER FOR REINFORCING RUBBER COMPOSITES AND METHOD OF MAKING SAME

[75] Inventors: Milan F. Kozak, Raleigh; Mark W. Taylor, Cary, both of N.C.; Ronald C. Elder, Dayton, Ohio

[73] Assignee: Monsanto Company, St. Louis, Mo.

[22] Filed: Nov. 24, 1975

[21] Appl. No.: 634,965

[52] U.S. Cl. ..... 148/12 B; 148/12.4

[51] Int. Cl.[2] ..... C21D 9/52

[58] Field of Search ..... 148/12 B, 12.4, 36; 29/193

[56] References Cited

UNITED STATES PATENTS

| | | | |
|---|---|---|---|
| 3,580,746 | 5/1971 | Behar | 148/12 B |
| 3,953,250 | 4/1976 | Golland et al. | 29/193 |

*Primary Examiner*—W. Stallard

*Attorney, Agent, or Firm*—Donald J. Fitzpatrick

[57] ABSTRACT

A steel member, essentially rectangular in cross-section, obtained by mechanically working round steel stock, having an aspect ratio greater than 2, wherein the member is characterized by a tensile strength greater than 200 KSI, a fatigue endurance limit greater than 100 KSI and a heat treated microstructure of tempered martensite, bainite or mixtures thereof.

A method is disclosed for making a steel member comprising the steps of providing steel stock with a round cross-section having a pearlitic microstructure and at least 0.35 percent carbon, forming an essentially rectangular member having an aspect ratio of at least 2 and heat treating the member so as to provide a microstructure of tempered martensite, bainite or mixtures thereof.

3 Claims, 6 Drawing Figures

STEEL MEMBER FOR REINFORCING RUBBER COMPOSITES AND METHOD OF MAKING SAME

BACKGROUND OF THE INVENTION

1. Field of the Invention

This invention relates to reinforcing members suitable for use in rubber composite structures and more particularly to a steel ribbon obtained by mechanically deforming round steel stock and then heat treating the stock.

2. Description of the Prior Art

The use of steel in various geometric configurations for reinforcing rubber articles is well known. A generally accepted form of reinforcement is to use steel filaments twisted together to form a strand. U.S. Pat. No. 3,762,145 discloses this well known method for reinforcing rubber articles and particularly pneumatic tires. Another technique for reinforcing pneumatic tires is to use reinforcing elements in the form of thin flat strips. Such elements are disclosed in recently issued U.S. Pat. Nos. 3,667,529; 3,794,097 and others dating back to the nineteenth century.

In copending patent application, Ser. No. 551,224, filed on Feb. 19, 1975 by John M. Chamberlin and assigned to the assignee of this invention, there is disclosed an improved steel reinforcing member. This steel member is in the form of a ribbon characterized by a tensile strength greater than 200 KSI and a microstructure of tempered martensite, bainite or mixtures thereof. This product was obtained by slitting steel coil stock and then continuously heat treating the stock so as to obtain the desired microstructure. It was determined that optimum physical properties in this product were obtained by virtue of the heat treated microstructure.

As an alternative to the approach of obtaining ribbon by slitting coil stock the feasibility of mechanically working high carbon wire into the desired rectangular cross-section was investigated. The starting stock would have a pearlitic microstructure and it was theorized that mechanically changing the cross-section from round to rectangular would yield at least comparable results to the heat treated slit ribbon product. Another significant property desired in a reinforcing member, particularly for pneumatic tires, is that of resistance to fatigue failure. Heat treated slit ribbon was further characterized by a high fatigue endurance limit (FEL). Since the starting stock for mechanical working would be pearlitic in nature it was assumed that a high FEL would be obtained from the round stock because it is well known in the art that pearlitic steels are tougher than martensitic or bainitic steels.

Pearlitic wire was mechanically converted into ribbon by passing it through a series of rolls. It was anticipated that flattening such wire might generate a series of longitudinal edge cracks and these cracks would seriously hamper the use of this product as a reinforcing member. An evaluation of the flattened ribbon showed that edge cracking did not materialize into a problem. Tensile properties of the ribbon were found to be satisfactory, however, the FEL was not comparable to that obtained in heat treated ribbon. The FEL was unexpectedly low when one considers that the starting material was pearlitic and such a deterioration in fatigue was not anticipated. As a matter of fact fatigue resistance was poorer in the rolled and flattened product than in the starting wire stock. For use as a reinforcing member in a rubber composite such as a pneumatic tire the FEL of rolled ribbon was not satisfactory when compared to the FEL exhibited by heat treated ribbon.

The flattened ribbon was obtained by a single pass through a series of rolls wherein the cross-section of the wire was changed from round to rectangular. To improve the FEL various modifications were made in the method of converting the round cross-section. Different rolling practices were employed and no matter what method was employed FEL could not be appreciably improved. The FEL could not be made comparable to that of heat treated ribbon. Finally it was decided to heat treat the rolled product in an attempt to alleviate this serious restriction on the product's applicability. An immediate and unexpected result of heat treatment was the attainment of properties comparable to the heat treated slit ribbon and of particular importance was the marked improvement in FEL.

SUMMARY OF INVENTION

The present invention provides a steel member essentially rectangular in cross-section and characterized by a tensile strength greater than 200 KSI (140 Kg/m$^2$), a fatigue endurance limit greater than 100 KSI (70 Kg/m$^2$) and a heat treated microstructure of tempered martensite, bainite or mixtures thereof.

The present invention relates to a method for making a pneumatic tire reinforcing member by heat treating steel stock, obtained by converting wire into ribbon, having an aspect ratio greater than 2 so as to obtain a microstructure of tempered martensite, bainite or mixtures thereof.

The present invention allows steel stock in the form of wire containing at least about 0.35 percent carbon to be converted into ribbon-like tire reinforcing elements exhibiting high strength levels and good resistance to fatigue. This may be accomplished by converting steel stock with a round cross-section having a pearlitic microstructure and at least 0.35 percent carbon into an essentially rectangular member having an aspect ratio of at least 2 and then heat treating the member so as to obtain a microstructure of tempered martensite, bainite or mixtures thereof.

It is therefore an object of this invention to provide a steel reinforcing member characterized by a tensile strength greater than 200 KSI (140 Kg/m$^2$), a fatigue endurance limit much greater than 100 KSI (70 Kg/m$^2$), and heat treated microstructure of tempered martensite, bainite or mixtures thereof.

Another object of this invention is to provide a reinforcing member essentially rectangular in cross-section.

A still further object of this invention is to provide a method for converting round wire into a ribbon-like high strength reinforcing member.

DETAILED DESCRIPTION OF THE PREFERRED EMBODIMENT

Figure 1:
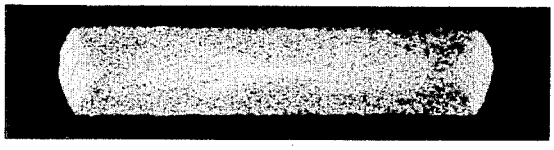
FIG. 1 is a photomicrograph taken at 50X showing the cross-section of a ribbon-like reinforcing member obtained by converting round wire stock.

The present invention provides a method for the production of a ribbon-like steel reinforcing member having good mechanical properties and a high fatigue endurance limit. Round wire is converted into an essentially rectangular cross-section and then heat treated to provide a microstructure of tempered martensite, bainite or mixtures thereof.

The method for the production of such reinforcing member comprises the steps of:

a. providing steel stock with a round cross-section having a carbon content of at least 0.35 percent and an essentially pearlitic structure;
b. forming an essentially rectangular member from said stock wherein said member has an aspect ratio of at least 2; and
c. heat treating said member to provide a microstructure of tempered martensite, bainite or mixtures thereof.

The starting stock is steel rod or wire generally having a carbon content more than about 0.35 percent and compositions within the range of A1S1 C1035 up to and including A1S1 C1095. The carbon content should be greater than about 0.35 percent in order that optimum mechanical properties can be developed in a manner as will hereinafter be more fully described. Furthermore, the microstructure of the starting stock should be essentially homogeneous with pearlite being the predominant microconstituent in order that an adequate response to heat treatment can be achieved.

The round rod or wire is then converted into an essentially rectangular cross-section. This can be accomplished in any conventional manner. The ribbon-like reinforcing member can be produced by passing the rod or wire through a series of forming rolls wherein the cross-section is sequentially changed as the steel passes through each succeeding roll. Another method for converting the round cross-section to rectangular would employ a "turk's head". Regardless of the mechanical set-up employed to convert the round starting stock, care must be exercised to avoid edge cracking during deformation. Such cracking can be avoided by controlling the rate at which the cross-section is converted.

Generally speaking, the product of this invention should have an aspect ratio greater than 2 wherein this ratio is defined as $$\frac{\text{ribbon width } (w)}{\text{ribbon thickness}} \quad \frac{(w)}{(t)}.$$

For satisfactory results $w$ is in the broad range of from 10 mils (0.0254 cm) to 200 mils (0.51 cm) and $t$ is in the broad range of 5 mils (0.011 cm) to 20 mils (0.051 cm).

The ribbon is then heat treated in order to impart satisfactory mechanical and fatigue properties to the reinforcing member. The ribbon, in coil form, is continuously passed into a furnace at a predetermined speed containing a protective or inert atmosphere and austenitized. After austenitization and homogenization, it is quenched whereupon austenite transforms into martensite, bainite and/or mixtures thereof. The resulting transformation products are dependent upon the quench rate. The microstructure has an essentially fine and uniform grain size.

In the case of transformation to martensite the quenched ribbon is continuously tempered by reheating at a lower temperature, i.e. 200°–400° C. Tempering restores ductility and removes stresses imparted by quenching. The resultant microstructure is tempered martensite, bainite or mixtures thereof. If bainite is formed upon transformation, tempering may not be required.

After heat treating, the properties of the ribbon, especially fatigue endurance limit, can be enhanced by mechanical straightening. This step removes any curvature or snakiness imparted by quenching while at the same time improving tensile and fatigue properties.

In practicing this invention it was decided that slit and heat treated ribbon would serve as a basis for comparison. For example a ribbon having an aspect ratio of 4, i.e., 10 mils thick + 40 mils wide, a nominal composition equivalent to C1060, a tensile strength of at least 200 KSI and a fatigue endurance limit of at least 100 KSI would be the point of reference. These properties were achieved by heat treating the slit ribbon so as to attain a microstructure of tempered martensite. The invention resides in achieving these same properties by converting round wire or rod into a rectangular ribbon having an aspect ratio greater than 2.

It was postulated that by converting a round wire or rod into a rectangular ribbon properties and performance comparable to the heretofore described heat treated slit ribbon could be obtained. By coupling a carbon centent of at least 0.60 percent and a pearlitic microstructure a comparable product would be obtained. The combination of cold work, a carbon content of at least 0.60 percent and a pearlitic microstructure would yield a satisfactory tensile level and toughness (as measured by FEL).

Wire having a diameter of 25 mils (.64 cm) and a carbon content of 0.78 percent was mechanically worked by passing it through a pair of rolls spaced apart approximately 0.010 inches thereby producing a continuous ribbon 10 mils × 50 mils (.26 × 1.27 cm). The ribbon exhibited the following properties tensile strength 311 KSI, percent elongation 2.9 percent, FEL approximately 70 KSI. Except for the FEL, it appeared that this product might perform satisfactorily as a reinforcing member in pneumatic tires. Tires were built and tested employing this material as a reinforcing member. The tires failed catastrophically shortly after the first sign of breakage was detected in the reinforcing belts. Such failure was determined by periodic X-ray analysis after a predetermined number of laps around a tire test test track. The failed ribbon was examined and it was determined that failure occurred in the fatigue mode. The performance of this product was poorer than anticipated. Laboratory evaluation of the product showed properties comparable to heat treated ribbon with the exception of a lower resistance to fatigue failure.

Figure 2:
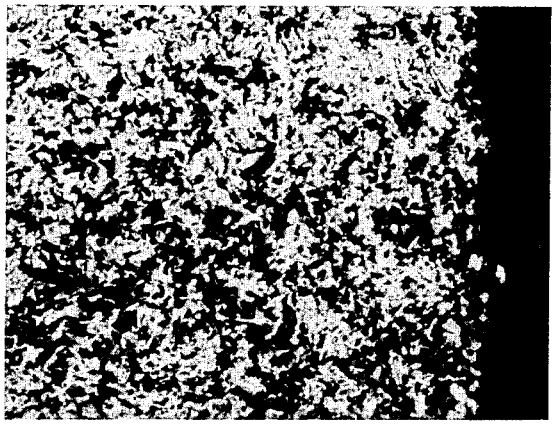
FIG. 2 is a photomicrograph taken at 1500X showing the microstructure at an edge of the reinforcing member.
Figure 3:
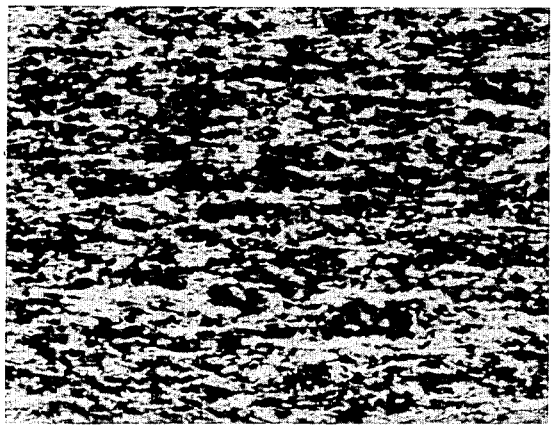
FIG. 3 is a photomicrograph taken at 1500X showing the microstructure at the center of the reinforcing member.

FIGS. 1, 2 and 3 show the microstructure of ribbon produced by converting round wire. It is readily apparent that the once-homogeneous pearlitic structure is now heterogeneous. As shown in FIG. 2, only the corners bear any resemblance to the original structure. Microhardness measurements show the effect of mechanically working the cross-section. The failed ribbon has a hardness of 481 Kp/mm² at the corners and 552 Kp/mm² (Vikers DPH, 50 gms load) in the center. Metallographic examination and microhardness testing showed that the edges were the softest material and were generally similar to the undeformed wire. As shown in FIG. 3, the center of the ribbon was highly deformed and exhibited the largest microhardness. The microhardness variation between the edge and centers was found to range from 70 to 100. The center structure could further be described as biaxially oriented, i.e., there are fibers running in the transverse direction as well as fibers in the original longitudinal direction.

In an effort to alter this heterogeneous structure and cause a concomitant increase in FEL various conversion techniques were tried. By using multiple rolling as opposed to a single reduction step for altering the cross-section the FEL could be increased approximately 10 KSI. Regardless of how the conversion steps were modified either by using multipasses or a turk's head the same generally biaxially heterogeneous structure was obtained.

It was then decided to austenitize the converted ribbon, quench to form martensite or bainite and then temper to improve ductility. After this form of heat treating was employed metallographic examination revealed a uniform, essentially homogeneous microstructure, all evidence of the previous heterogeneous structure resulting from conversion was eliminated.

Figure 4:
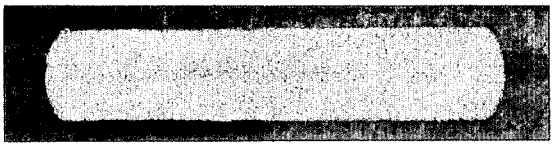
FIG. 4 is a photomicrograph taken at 50X showing the cross-section of the reinforcing member after heat treatment.
Figure 5:
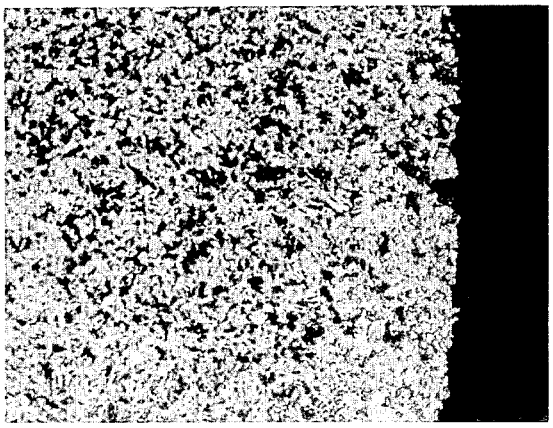
FIG. 5 is a photomicrograph taken at 1500X showing the microstructure at an edge of the reinforcing member after heat treatment.
Figure 6:
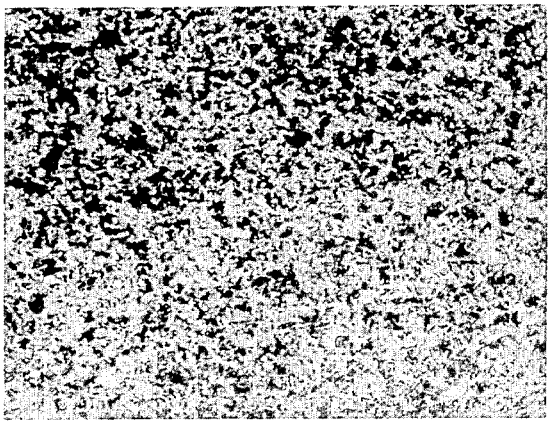
FIG. 6 is a photomicrograph taken at 1500X showing the microstructure at the center of the reinforcing member after heat treatment.

FIGS. 4–6 show the microstructure of the heat treated product of this invention. As observed in FIG. 4 the microstructure is uniform throughout the cross-section. There is no distortion or difference in structure between the edges and center that is so readily apparent in FIGS. 1–3. FIGS. 5 and 6 show the microstructure at the edges of the product is the same as that found at the center.

As disclosed in copending application Ser. No. 551,224, the disclosure of which is herein incorporated by request, the slit ribbon has a pair of roughened surfaces. These are the surfaces which define the thickness of the ribbon that fractured during slitting as the coil stock passed through the slitting apparatus. Alghough apparatus and processes have been developed to modify and alter the appearance of these surfaces, vestiages of slitting still remain. Upon examination, it is apparent that the ribbon was obtained by slitting. The reinforcing member of this invention has an essentially uniform cross-section, that is, it is smooth without any discontinuities or roughened areas on its outer surface. This smooth surface is a further distinction over slit reinforcing members.

The properties of flat ribbon obtained by direct conversion and by the method of this invention are shown in the accompanying tables.

TABLE I

SUMMARY OF MECHANICAL PROPERTIES

| Sample | Ultimate Tensile Strength KSI | Ultimate Tensile Strength Kg/m² | % Elong. | Yield Strength KSI | Yield Strength Kg/m² | % C. | FEL KSI | FEL Kg/m² |
|---|---|---|---|---|---|---|---|---|
| Direct Conversion: | | | | | | | | |
| C10 | 310 | 217 | 2.8 | 267 | 187 | .85 | *~75 | *~52 |
| C11 | 195 | 136 | 1.9 | 177 | 124 | .35 | ~70 | ~49 |
| C12 | 217 | 152 | 2.9 | 183 | 128 | .60 | — | — |
| C13 | 265 | 185 | 2.6 | 223 | 156 | .60 | ~80 | ~56 |
| C14 | 293 | 205 | 2.6 | 254 | 178 | .73 | — | — |
| C15 | 324 | 226 | 2.8 | 271 | 190 | .81 | ~110 | ~77 |
| KC1 | 305 | 213 | 2.1 | 286 | 196 | .78 | ~110 | ~77 |
| Direct Conversion and Mechanical Straightening: | | | | | | | | |
| C13 | 274 | 192 | 1.7 | 265 | 185 | .60 | ~85 | ~60 |
| C15 | 311 | 218 | 3.3 | 273 | 191 | .81 | 115–120 | 80–84 |
| Heat Treated After Conversion: | | | | | | | | |
| C10 | 370 | 258 | 4.6 | 3.2 | 218 | .85 | ~120 | ~84 |
| C11 | 245 | 171 | 2.4 | 162 | 113 | .35 | — | — |
| C13 | 385 | 270 | 3.8 | 300 | 210 | .60 | 140–150 | 98–105 |
| Heat Treated and Mechanically Straightened After Conversion: | | | | | | | | |
| C13 | 390 | 272 | 3.6 | 310 | 220 | .60 | 160–170 | 112–119 |

*"~" denotes approximation.

TABLE II

MICROHARDNESS SURVEY

| Sample No. | As Rolled Edge | As Rolled Center | Heated Treated Edge | Heated Treated Center |
|---|---|---|---|---|
| C-10 | 480 | 550 | 630 | 640 |
| | 485 | 560 | 640 | 640 |
| | 480 | 550 | 640 | 650 |
| | 480 | 550 | 640 | 650 |
| Average | 481 | 552 | 637 | 645 |

TABLE III

PERFORMANCE OF PRODUCT

| Product | | Grist Mill | Cobblestone (Laps) |
|---|---|---|---|
| Heat treated slit ribbon, 10×40 mils | | Passed | 7,000 Laps |
| Direct converted | C10 | Passed | Failed 3,000–5,000 |
| Direct converted | C11 | Failed | Not tested |
| | C13 | Passed | Not tested |
| | C15 | Passed | Not tested |
| Heat treated | C13 | Passed | Not tested |

Table I clearly shows the improvement in tensile properties and fatigue endurance limit by processing the ribbon in accordance with the method disclosed herein. The heat treated samples exhibit superior properties over the direct converted samples. Sample C13 was also mechanically straightened and the properties were enhanced over the heat treated samples and markedly over the direct converted samples.

Table II shows the microhardness variation from edge to center for the as-rolled ribbon. After the heat treating, the ribbon is essentially uniform from edge to center.

Although the present invention has been described and illustrated in connection with the preceding preferred embodiment, it is to be understood that modifications and variations may be resorted to without departing from the spirit of the invention as those skilled in the art will readily understand. Such modifications and variations are considered within the scope of the present invention as defined on the appended claims.

We claim:

1. A method for making steel articles for reinforcing rubber composites which comprises:

a. providing steel stock with a round cross-section having a carbon content of at least 0.35 percent and an essentially pearlitic microstructure;

b.. forming an essentially rectangular member from said stock wherein said member has an aspect ratio of at least 2; and c. heat treating said member to provide a microstructure of tempered martensite, bainite or mixtures thereof.

2. The method of claim 1 wherein said heat treating comprises austenitizing, quenching and tempering said member.

3. The method of claimm 1 wherein said members are passed through a mechanical straightener after said heat treating.

* * * * *

UNITED STATES PATENT OFFICE

CERTIFICATE OF CORRECTION

Patent No. 4,017,338 Dated April 12, 1977

Inventor(s) Milan F. Kozak et al.

It is certified that error appears in the above-identified patent and that said Letters Patent are hereby corrected as shown below:

Column 4, line 26 "+" should read -- x --.

Column 6, Table I, under heading "Heat Treated After Conversion", "3.2" under "Yield Strength" should read -- 312 --.

Column 8, line 13, "claimm" should read -- claim --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*